US008641222B2

(12) United States Patent
Lydick

(10) Patent No.: US 8,641,222 B2
(45) Date of Patent: Feb. 4, 2014

(54) HAIRCUTTING SHEARS WITH ILLUMINATED LEVEL

(76) Inventor: John C. Lydick, Panama City, FL (US)

( * ) Notice: Subject to any disclaimer, the term of this patent is extended or adjusted under 35 U.S.C. 154(b) by 99 days.

(21) Appl. No.: 13/485,472

(22) Filed: May 31, 2012

(65) Prior Publication Data

US 2013/0322060 A1 Dec. 5, 2013

(51) Int. Cl.
*B26B 19/46* (2006.01)
*B26B 21/46* (2006.01)

(52) U.S. Cl.
USPC ..... 362/115; 362/109; 362/119; 362/120; 362/234; 33/348.2; 33/366.23; 30/123; 30/233

(58) Field of Classification Search
USPC ..... 362/109, 115, 119, 120, 234, 253; 33/348.2, 366.23; 30/123, 233
See application file for complete search history.

(56) References Cited

U.S. PATENT DOCUMENTS

| | | | | |
|---|---|---|---|---|
| 4,215,474 | A | 8/1980 | Kelley | |
| 2004/0139615 | A1 * | 7/2004 | Gianatasio | 30/233 |
| 2011/0005091 | A1 | 1/2011 | Pedersen | |

FOREIGN PATENT DOCUMENTS

| | | | |
|---|---|---|---|
| DE | 36 04 852 | A1 | 8/1987 |

* cited by examiner

*Primary Examiner* — Stephen F Husar
(74) *Attorney, Agent, or Firm* — Richard C. Litman

(57) ABSTRACT

The haircutting shears with illuminated level are adapted to aid a hairstylist in performing precise haircutting procedures. The shears are provided with a spirit level encased in an illuminated housing, which is disposed on the outer surface of one of the blades of the shears. The illuminated spirit level allows the stylist to quickly view the level to determine if the cutting angles are being executed in a desired manner. An integrated circuit device is housed in the shears and connected to the level for obtaining and storing data therefrom. A USB port is provided for connecting the integrated circuit device to a processor or other display device. The USB port also provides a charging means for the illuminating device.

11 Claims, 3 Drawing Sheets

HAIRCUTTING SHEARS WITH ILLUMINATED LEVEL

BACKGROUND OF THE INVENTION

1. Field of the Invention

The present invention generally relates to hair salon tools, and particularly to haircutting shears having an illuminated level attached thereto.

2. Description of the Related Art

Hair cutting whether executed at an angle, level, zero degree, elevated or over directed is best when accurate and precise. Heretofore, hairstylists have generally relied on only visual examination and experience to determine if the hair is correctly cut to attain the desired hairstyle. The cutting tools available in the related art to aid the stylist in making the above determination have proven to be less than satisfactory in that they lack the ability to determine the precision of the cut and/or the ability to display the information in an easily viewable manner. A tool that could readily determine the precision of a haircut, display the information in an easily viewable way and store such data for retrieval at subsequent appointments with the same client or for teaching purposes would surely be a welcome addition to the hairstyling industry. Thus, haircutting shears having an illuminated level solving the aforementioned problems is desired.

SUMMARY OF THE INVENTION

The present invention is drawn to haircutting shears having means to aid a hairstylist in performing precise haircutting procedures. The shears are provided with a spirit level encased in an illuminated housing, which is disposed on the outer surface of the blade of the shear. The illuminated spirit level allows the stylist to quickly view the level to determine if the cutting angles are being executed in a desired manner. An integrated circuit device (microchip, wireless transmitter, etc.) is housed in the shears and connected to the level for obtaining and storing data therefrom. A USB port is provided for connecting the integrated circuit device to a processor or other display device. The USB port also provides a charging means for the illuminating device. It should be noted that other means such as an inductive coupling device may be utilized for recharge if desired. It should also be noted that the level could be incorporated in other hairstyling tools such as a comb or the like.

Accordingly, the invention presents haircutting shears having an illuminated level device disposed thereon to allow quick determination of the precision of cutting angles being performed. The invention also incorporates means to store and retrieve data relative to the performed cutting angles for display. The invention provides for improved elements thereof in an arrangement for the purposes described that are dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
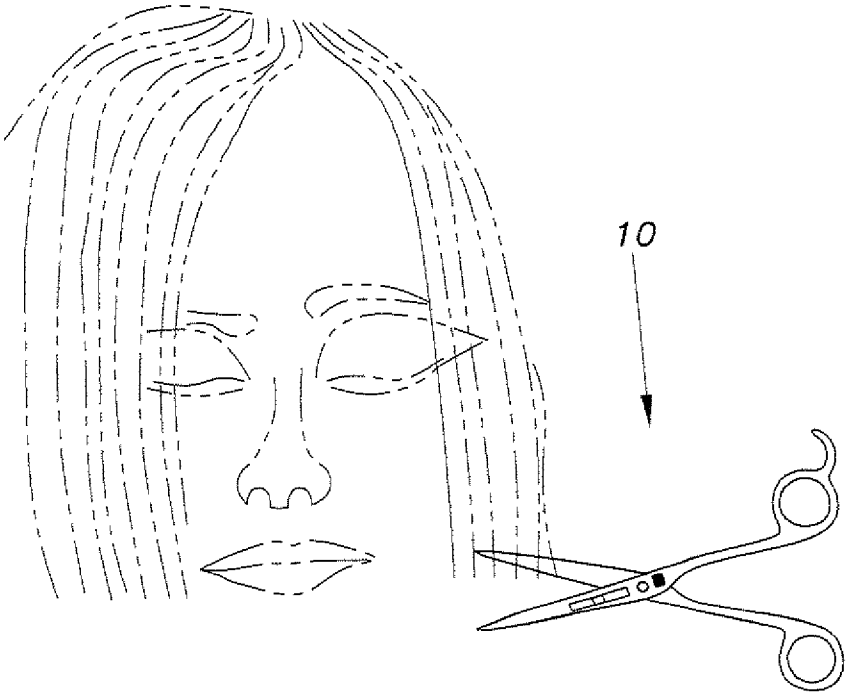
FIG. 1 is an environmental, perspective view of haircutting shears with illuminated level according to the present invention.
Figure 2:
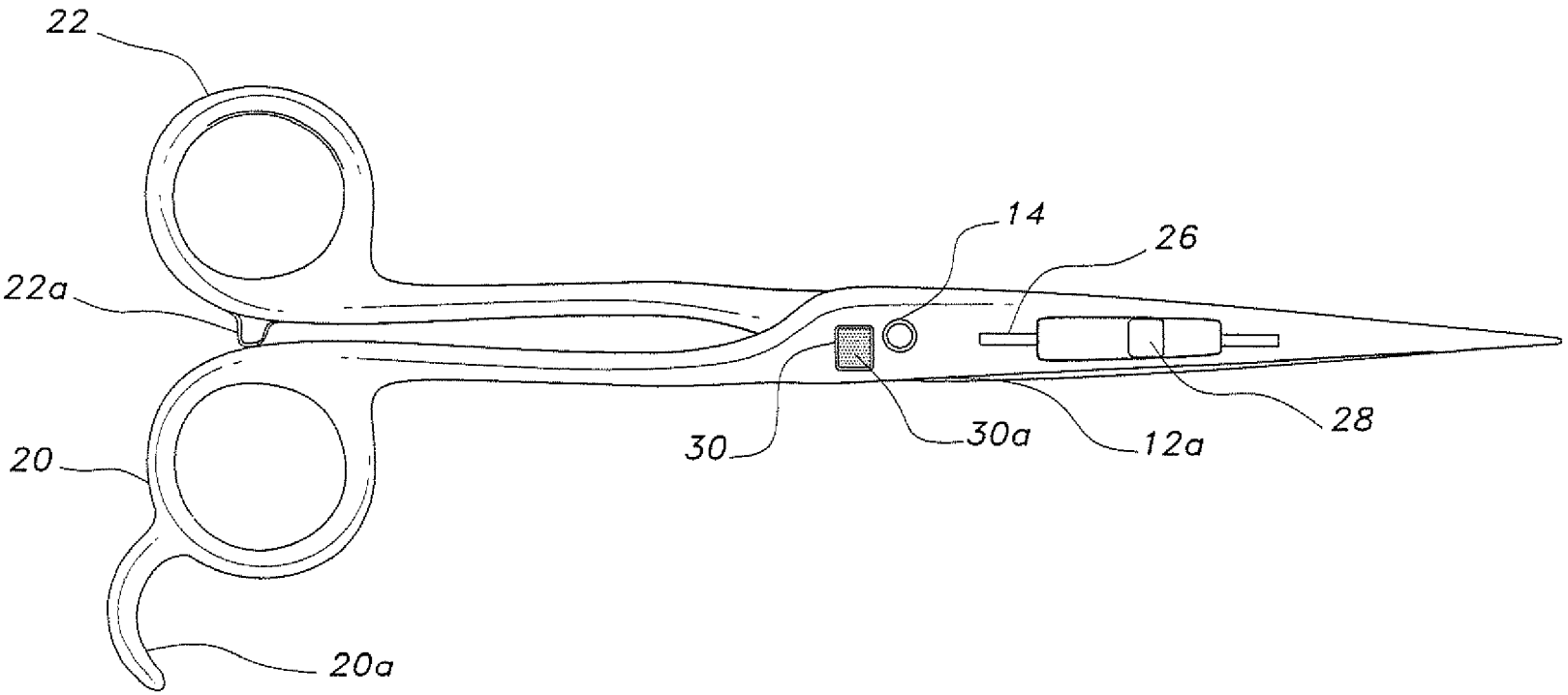
FIG. 2 is a top view of the haircutting shears of FIG. 1, shown in a closed position.
Figure 3:
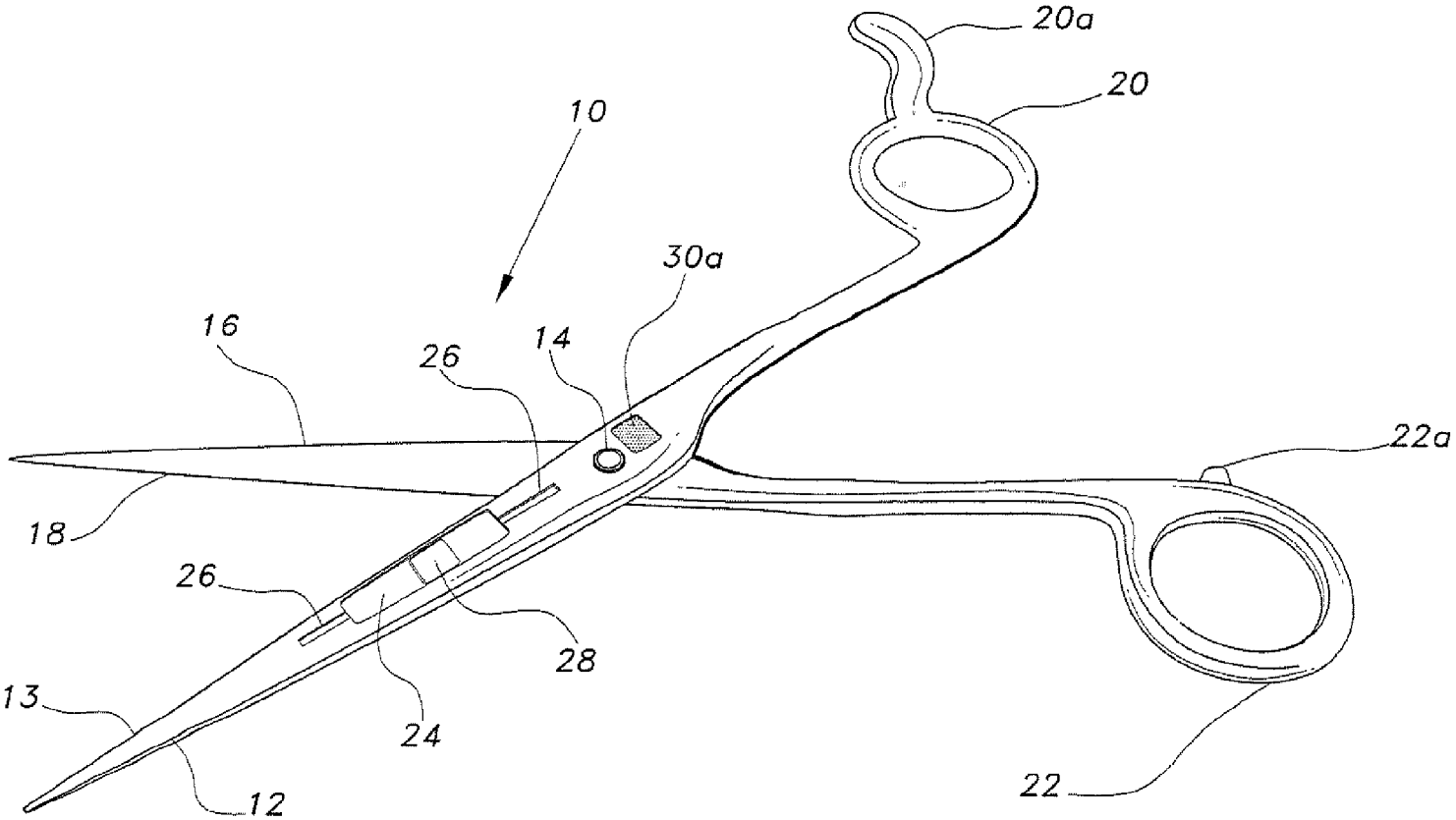
FIG. 3 is a perspective view of the haircutting shears of FIG. 1, shown in an open position.

Referring to FIGS. 1-3 of the drawings, the haircutting shears with illuminated level are generally indicated at 10. Although shears have two opposed movable blades, the illuminated level blade will herein be referred to as the stationary blade (whether for right or left handed shears). When cutting hair, the stylist will normally hold one blade of the cutting shears stationary and will pivot the other blade (referred to herein as the "movable blade") to cut or trim the hair. The haircutting shears 10 comprise a first or stationary blade 12 having an upper or outer surface 12*a*, and having a first end, the blade 12 defining an elongate cutting edge 13. The second or movable blade 16 has a first end, the blade 16 defining an elongate cutting edge 18. The stationary blade 12 terminates at a second end in a conventional bow handle 20 having a finger rest 20*a* attached thereto. The movable blade 16 terminates at a second end in a conventional ring handle 22 having a compression stop 22*a* disposed thereon. The blades are pivoted to each other at 14. For optimum viewing, a transparent housing 24 is attached to the upper surface 12*a* of the stationary blade 12. The housing 24 is illuminated by an LED (light emitting diode) device 26 proximate to or inside the housing 24, the housing 24 enclosing a spirit level 28 therein. The housing 24 may be fabricated from any suitable transparent material (glass, plastic, etc.).

An integrated circuit device (microchip, wireless data transmitter, etc.) 30*a* and at least one USB port 30 are disposed on the shears. Although illustrated as disposed in the stationary blade 12, it should be noted that the integrated circuit device 30*a* and USB port 30 may be located at any suitable and/or convenient area on the shears 10. As noted above, the integrated circuit device 30*a* will log in and store data relative to the angles utilized in the previous cuts, the data being provided by a sensor connected to the spirit level. The USB port 30 is used to charge the LED illuminating device 26 when necessary, and also to connect the integrated circuit device 30*a* to a processor or the like, whereby the stored data can be displayed.

It is to be understood that the present invention is not limited to the embodiments described above, but encompasses any and all embodiments within the scope of the following claims.

I claim:

1. Haircutting shears, comprising:

a first blade having a first end, a second end, and an upper surface, the first blade defining a first elongate cutting edge;

a second blade having a first end and a second end, the second blade being pivotally attached to the first blade, the second blade defining a second elongate cutting edge;

a bow handle disposed at the second end of the first blade;

a ring handle disposed at the second end of the second blade;

a transparent housing attached to the upper surface of the first blade;

a spirit level disposed in the housing; and an illuminating device disposed on the upper surface proximate the transparent housing for illuminating the spirit level.

2. The haircutting shears according to claim 1, wherein said illuminating device is an LED.

3. The hair cutting shears according to claim 1, further including a finger rest disposed on said bow handle.

4. The haircutting shears according to claim 1, further including a compression stop disposed on said ring handle.

5. The haircutting shears according to claim 1, further including an integrated circuit device disposed on said shears, the integrated circuit device being connected to said spirit level for storing data received from said spirit level.

6. The haircutting shears according to claim 1, further including at least one USB port disposed on said stationary blade for charging the illuminating device.

7. Haircutting shears, comprising:

a first blade having a first end, a second end, and an upper surface, the stationary blade defining a first elongate cutting edge;

a second blade having a first end and a second end, the second blade being pivotally attached to the first blade, the second blade defining a second elongate cutting edge;

a bow handle disposed at the second end of the first blade;

a ring handle disposed at the second end of the second blade;

a transparent housing attached to the upper surface of the first blade;

a spirit level disposed in the housing;

an LED disposed on the upper surface of the first blade proximate the housing for illuminating the spirit level; and an integrated circuit device disposed on the first blade, the integrated circuit device being connected to the spirit level for storing data received from the spirit level.

8. The haircutting shears according to claim 7, further including a finger rest disposed on said bow handle.

9. The haircutting shears according to claim 7, further including a compression stop disposed on said ring handle.

10. The haircutting shears according to claim 7, further including at least one USB port disposed on said first blade.

11. Haircutting shears, comprising:

a first blade having a first end, a second end, and an upper surface, the first blade defining a first elongate cutting edge;

a second blade having a first end and a second end, the second blade being pivotally attached to the first blade, the second blade defining a second elongate cutting edge;

a bow handle disposed at the second end of the first blade, the bow handle having a finger rest disposed thereon;

a ring handle disposed at the second end of the second blade, the ring handle having a compression stop disposed thereon;

a transparent housing attached to the upper surface of the first blade;

a spirit level disposed in the housing;

an LED disposed on the upper surface of the first blade proximate the housing, the LED illuminating the spirit level;

an integrated circuit device disposed on the first blade, the integrated circuit device being connected to the spirit level for storing data received from the spirit level; and at least one USB port disposed on the stationary blade.

* * * * *